US006360668B1

(12) United States Patent
Rauch

(10) Patent No.: US 6,360,668 B1
(45) Date of Patent: Mar. 26, 2002

(54) ADAPTABLE PLATFORM DOOR SYSTEM

(75) Inventor: Jurgen Rauch, Helene-Weber-Allee 16, Munich D-80637 (DE)

(73) Assignee: Jurgen Rauch, Munich (DE)

( * ) Notice: Subject to any disclaimer, the term of this patent is extended or adjusted under 35 U.S.C. 154(b) by 0 days.

(21) Appl. No.: 09/601,182

(22) PCT Filed: Feb. 2, 1999

(86) PCT No.: PCT/EP99/00672

§ 371 Date: Aug. 31, 2000

§ 102(e) Date: Aug. 31, 2000

(87) PCT Pub. No.: WO99/38747

PCT Pub. Date: Aug. 5, 1999

(30) Foreign Application Priority Data

Feb. 2, 1998 (DE) ..... 198 03 991

(51) Int. Cl.[7] ..... B61B 1/00

(52) U.S. Cl. ..... 104/30

(58) Field of Search ..... 104/27, 28, 30; 105/332, 339, 341; 160/186, 187, 188

(56) References Cited

U.S. PATENT DOCUMENTS 4,048,755 A * 9/1977 Wolak et al. ..... 49/130
5,295,441 A * 3/1994 Kawanishi et al. ..... 104/28
6,105,905 A * 8/2000 Spence ..... 246/127

* cited by examiner

*Primary Examiner*—S. Joseph Morano
*Assistant Examiner*—Robert J. McCarry, Jr.
(74) *Attorney, Agent, or Firm*—Haynes and Boone, LLP

(57) ABSTRACT

A platform door system (1) comprises a barrier (10) which includes barrier elements (12), which can be aligned along a track (3) and/or a platform (4), the barrier elements (12) being able to be so displaced that same may be at least partly made flush with each other so that freely selectable, predetermined openings (5) are created along the track (3) and/or along the platform (4).

27 Claims, 8 Drawing Sheets

ADAPTABLE PLATFORM DOOR SYSTEM

The invention relates to an adaptable platform door system and more particularly to an adaptable platform door system for railroad stations used by automatically controlled trains and/or automatically controlled and driverless trains. Furthermore the present invention relates to a method for the control of such an adaptable platform door system.

The use of driverless trains, which are for example controlled by a computer, means that entry into a station is exacting from the safety technology aspect. Serious accidents may occur, if waiting passengers assume positions close to the track, since a remote controlled train cannot reliably react to such events or for this purpose additional and generally externally provided measures are necessary.

Moreover in the greater part of known railroad and subway systems there is the problem of the necessity of several different types of trains and rolling stock having to halt in a station, which have different configurations of doors. Furthermore, it is possible for a train not to be able to halt precisely owing to external influences (weather, atmospheric humidity, ice etc.) at a given point (so-called "slither").

The German patent publication 2,462,031 A1 describes a station for automatic railroads with a restraining grid including a railing. This however does not mean that passengers will not get on the track; furthermore there is the danger of limbs getting through the grid into the track area and the space corresponding to the overall cross section of the train.

In the German patent publication 3,132,296 A1 a security partition wall for platforms is disclosed, which has corresponding sliding doors. This security partition wall is a stationary built-in structure and has gaps in the walls, into which only a predetermined sliding door is inserted. This wall calls for use with trains only having a fixed configuration of doors.

In the German patent publication 3,214,602 A1 a transport system is disclosed having two barriers defining three areas on the platform, through which the stream of passengers may be conducted. In this system the openings in the barriers are stationary.

In the German patent publication 69,204,934 A1 a "folding door device for rail vehicles" is described. In this case folding elements are folded into the platform area or out of it, something which may mean danger for the passengers on the platform at certain points.

One object of the present invention is therefore to provide a platform door system, which can be employed for different types of train or, respectively, carriages and different accuracies of halting.

This object is to be achieved by the arrangement as claimed in the independent claims. Further advantageous developments are specified in the dependent claims.

More particularly, the object is attained by a platform door system 1 comprising a barrier 10 having screen or barrier elements 12 able to be aligned along a track 3 and/or a platform 4, the barrier elements 12 being able to be so shifted in relation to one another that same at least partially overlap so that freely selectable predetermined openings 5 and opening sizes may be provided along the track 3 and/or platform 4. Owing to the shifting of the individual barrier elements in relation to each other danger can be avoided to the extent that no passenger will be clamped or injured during opening or closing of the platform door system. At the same time the platform door systems of the invention provides flexible or adaptable systems able to set any desired door opening configuration, since they may do without permanently installed components. This is more particularly advantageous, when—be it for reasons of different trains of different dates of construction (and partly different in structure), be it owing to different use of a platform for different types of trains (for instance: local traffic with many wider doors and long distance traffic with a few narrow doors)—different types of trains are to halt at the same platform one after the other. Permanently installed wall elements and sliding doors would here obstruct different train doors making disembarking impossible at such positions. Owing to the adaptable system of the present invention it is possible, even in an emergency or in the case of a non-scheduled halt of a train at a position on the platform not intended for it, for a configuration of openings corresponding to the actual position of the train (and its configuration doors to be opened) to be produced. The result is that investments in platform security and in new rolling stock no longer lead to mutual obstruction.

In the platform door system of the invention it is advantageous for the barrier elements 12 to be designed in the form of panels. It is more particularly preferred for the barrier elements 12 to be designed rectangularly. By having a panel-like, i. e. planar design, it is possible for the barrier elements to be readily shifted in relation to each other. Owing to the rectangular design it is possible for the barrier elements to be fully aligned with one another and they then make available a suitable space for the passengers to pass through. It would be feasible for the barrier elements to be in the form of triangular plates, which like a shutter opening could be shifted in relation to one another. It would also be feasible for the barrier elements to be curved in plan view. This is particularly preferred in the case of curved platform or, respectively, curved platform edges. The invention also contemplates elements in the form of an array of straight parts at an angle to each other. This is particularly preferred when the platform edge is curved in form.

A form of the elements as rhombs as seen in elevation would also be possible in order to provide security at platform edges in stations erected on a slope (with a sloping surface). A design is particularly preferred in the case of which barrier elements are provided which are preferably narrow, elongated and/or lamellar, which can be adapted to stations whose slope varies along the platform edge and which constitute an adaptable barrier for the platform.

A further embodiment of the present platform door system is characterized by the barrier elements 12 comprising transparent materials; more especially if the barrier elements 12 prevailingly comprise glass and/or acrylics; and more particularly same can consist entirely of transparent materials. This means that when a train arrives the passengers will be able to see it and estimate where the doors will open and where not. Thus the danger of accidents is reduced, since unexpected opening of the doors is substantially prevented. Moreover, more particularly in the case of a subway, the passengers using the system will as well be afforded an opportunity to see the position of halting of the train at least at the moment of its arrival and when it comes to a halt and to obtain an impression at least of the platform, to orientate themselves and accordingly to get a subjective sense of security. It is preferred for the inherent static effect of such transparent materials to be used. It is particularly preferred for additional mechanical parts to be set in the transparent material. Such mechanical parts are preferably parts which have a different mechanical strength and/or a different modulus of elasticity. This means that special areas of the barrier elements may be adapted to practical requirements such as for instance as regards a high wear rate, frictional forces, warping or fracture loads. The materials are preferably selected from the group comprising metals, plastics, which can resist high loads—more particularly acrylics—ceramic materials or combinations thereof.

In the case of a further embodiment of the invention a platform door system is provided, in the case of which the barrier elements 12 can be shifted in relation to one another. More particularly, a platform door system is provided, in which the barrier elements 12 can be shifted perpendicularly to a line along the track 3 and/or platform 4. This slight shift or offset of the barrier elements in relation to each other means that the system may be brought into an operational position in an early phase, from which position the opening configuration as such may be produced rapidly. Simultaneously this phase serves to alert the waiting passengers who can now count on arrival of the train within a short time. Preferably such a phase is accompanied by acoustic and/or optical signals, i. e. in this phase acoustic signals or, preferably, colored optical signals provide an indication that opening is about to take place.

In the case of a preferred embodiment at least one barrier element can be designed to be pivoted and/or lowered and/or pulled up. In this case individual barrier elements may be lowered to be underneath the platform edge. It is furthermore possible to draw up the barrier elements to a level allowing the passengers to pass by. This means that accurate adaptation of the openings to the geometry of the doors is not only possible laterally but also downward and upward.

In the case of a further advantageous embodiment of the platform door system of the present invention the barrier 10 comprises barrier elements 12 of different width. Having barrier elements of different width means that optimum combinations of barrier elements may be employed in accordance with the expected trains for the station. It is possible therefore for the inertia of barrier elements to be moved to be kept as low as possible. In the case of special combinations of trains and platform or, respectively, in the case of a certain configuration of doors a constant width of the barrier elements may be preferred.

In the case of a further platform door system of the present invention the barrier 10 can be shifted along the track 3 and/or along the platform 4—i. e. along the platform edge—and the barrier 10 may be more particularly shifted by a train or preferably more especially entrained by it. On arrival a train may be subject to slithering, for example when the track is wet or is covered with leaves. The train will then slither past the intended halting point. Since the entire barrier can be shifted, such slither is compensated for, since then the entire barrier (with the pre-programmed configuration of openings or array) is trailed along to keep up with the train so that the openings are again exactly opposite to the door positions. It is particularly preferred for the slithering train to entrain a coupling member along the path of slither, which is either directly coupled with the barrier and entrains it with the train or travels along this path with a time delay. It is particularly preferred for the excess energy of the slithering train to be employed to entrain the barrier.

In a still further advantageous platform door system in accordance with the present invention the barrier elements 12 possess locking devices 14 and/or sealing devices 15. The locking device renders it possible for the barrier elements to be additionally anchored and stabilized. Accordingly the barrier may be reinforced to resist the pressure wave of a non-stop train and more particularly of a non-stop train traveling at a high speed and to protect the passengers waiting on the platform therefrom. A further point is that sealing devices may as well be provided with advantage rendering it possible to seal off the platform barrier from the track in an odor-proof or gas-proof manner hermetically from the track areas. It is then possible to ensure systematic control of the air condition on the platforms without outside climatic condition having a disturbing effect on the environment via the track area. More particularly, it is hence possible to seal off platforms hermetically if owing to a fire, smog or toxic substance alarm, particularly in underground stations, this appears desirable. Air conditioning of stations and, respectively, platforms is preferably facilitated.

Furthermore it is preferred to provide a minimum distance between the train or, respectively, open train door and open platform door leaf. This meets safety requirements, since there is then a reduction in the risk of injury. Moreover a sealing effect may be rendered possible, which is advantageous in the case of evacuation of a train via the station. The sealing effect is also advantageous for minimizing air conditioning losses.

It is preferred, more particularly in the case of different carriage widths, to provide a possibility of shifting the entire wall of barrier elements orthogonally or at a right angle to the platform edge. This means that the open train may be sealed off from the space around the track. Preferably the intermediate spaces between the doors of the arriving train and the barrier elements are blown clear and put under pressure as an air lock prior to opening.

It is more especially preferred for the locking device 14 to comprise at least one bolt. One respective bolt may be provided at on end of the narrow side of the barrier device so that for each barrier element four bolts are provided. These bolts may then be employed as guide pins in a guide for shifting the barrier elements and for locking to be extended into recesses provided for this purpose in the guides and accordingly lock the barrier element in the guide. The sealing device 15 is preferably an expandable plastic bead. Accordingly it is possible to pressurize such bead with a medium such as air or oil to cause the bead to be thrust against the sealing element and produce a hermetic seal. In addition it is possible to provide a device in the platform for producing a gage pressure in order to prevent escape of undesired gases into the platform space in the case of defective sealing.

In the case of a further advantageous platform door system in accordance with the present invention a control device 20 is provided, which controls drive devices 21, which can offset and/or shift the barrier elements 12 into a predetermined position. Using this control device it is possible for the individual sealing elements to be so arranged that the desired configuration of openings is produced. It is preferred for this control device to also shift the sealing elements in order to then be able to shift them more readily. These drive means may comprise motors, particularly electric motors, guides, chains, toothed belts of metal or, preferably, plastic, or also however so-called spindle drives or pneumatic or hydraulic drives for the sealing elements. The drive devices may be arranged above, underneath or to the side of the respective barrier elements to be moved.

In the case of a further preferred platform door system of this invention it is possible for the barrier elements 12 to be provided with a functional marking. In particular they may in a predetermined area bear a predetermined color. The predetermined area will preferably be a form or figure suitable for directing passengers, and for example arrows or traffic signs may be employed. These functional markings may be static or, preferably, animated, i. e. changing in time. Accordingly changing texts and changing directions may be preferably provided.

Accordingly prior to or during the arrival of a train certain barrier elements may be provided with a functional marking to the effect that a door will be opened in a particular area. Furthermore it is possible to indicate that in this area passengers may only get off but not get on the train or vice versa. The functional marking can be projected onto the barrier elements. The functional marking may also take the form of acoustic signals. It is preferred for different areas of the barrier elements to have different colors, by means of which a passenger may be informed about the arriving train and the door form or, respectively, configuration of openings. Thus shades of green may be preferably employed to indicate where people can get on the train and shades of red may be utilized to indicate where they can only get off. Shades of yellow or orange can be employed to indicate areas where it is not possible to expect an opening. In the case of at least partially transparent barrier elements it is possible for the functional markings also to be shown on the side opposite to the platform; more especially by projection of the functional markings on the wall present there. This functional marking may comprise moving pictures.

Furthermore the invention also contemplates the provision of advertising matter on the barrier elements or parts thereof. It would also be possible to provide the barrier elements or parts thereof for interactive use by the passengers, who could then communicate using touch sensitive areas with a predetermined system and thus for example make purchases or order tickets for the opera or for the railroad etc., or could obtain information about the availability of information on travel routes and time tables. It is preferred for the barrier elements or parts thereof to be in the form of touch sensitive areas and more particularly barrier elements or parts thereof are in the form of LCD areas. In surfaces or parts thereof of the barrier elements images are thus produced, which can inform or entertain the waiting passengers. It would also be conceivable to represent security information or directions for orderly organization of the station using the barrier elements.

It is preferred for an input unit 22 to be provided, via which a predetermined configuration of openings 5 may be selected. The input unit 22 is preferably provided in a tunnel leading to the station, an automatic transmission of the input data to the platform door system taking place. It is particularly preferred for an input unit to be provided in the dispatcher or control center and to be so designed that automatically transferred data or manually entered data may be passed on to the platform door system. This means that the platform door system receives the requested configuration of openings. The input unit 22 is preferably supplied with information signals relating to the characteristics and/or distribution of passengers in the train and/or the distribution of passengers on the platform 4. Thus the configuration of the doors of the arriving train may be communicated to the system. Thus it is possible for the system to be informed as well about which doors of the train will not open and accordingly which platform doors do not have to open. The system can also be informed as to what passenger distribution is to be expected at different doors. The functional markings may be established in this manner.

In accordance with a further embodiment of the present invention platform door systems are provided, in which the information signals are obtained via a bar code reading device in front of the platform 4 and/or in the case of which the information signals are obtained via a monitor system so as to train and/or in the case of which the information signals are entered using an input device, more particularly a keyboard or a graphics panel. These developments mean that there is a possibility of ascertaining the control parameters necessary for shortening wait times when the train halts and transferring them to the system so that using the optimum configuration of openings and the necessary functional marking of the platform doors the passengers may be informed as soon as possible concerning the arrangement of openings. It is more particularly possible to provide for input of information by means of a bar code reading device in the tunnel leading to the station or underneath the platform edge opposite to the outer side of the train. This applies more particularly for unchanged information about the train itself such as the door arrangement of the carriages, the door widths/opening widths. Information about the distribution of the passengers themselves may be obtained by video cameras in the interior of train.

A further preferred platform door system comprises structural devices 7 and 8 in front of and/or behind the platform, with which the track area may be separated or shut off and may be more particularly hermetically separated. This means that it is possible, more particularly in crises, to shut off the entire station and to utilize underground stations preferentially for protection of civilians. In combination with corresponding structural barrier devices at the entrance to the underground station it is thus possible to provide readily reached and efficient civilian protection structures in an urban area. These structural means may be displaceable concrete components. Owing to the platform door system a further shield for the track is provided and therefore an air lock is available, by which a protection of the platform space is maintained even following opening of the structural device for a short time.

The object is furthermore achieved by a method for controlling barrier elements 12 of a barrier 10 of a platform door system of the invention, which comprises the following steps: displacement of the individual barrier elements 12 so that they are at least partially aligned so that a predetermined configuration of openings is produced corresponding to the opening doors of a train on arrival. Preferably this method begins with the step of offsetting the individual barrier elements 12 in relation to one another.

In the following further advantageous features of the invention will be described with reference to the drawings.

Figure 1:
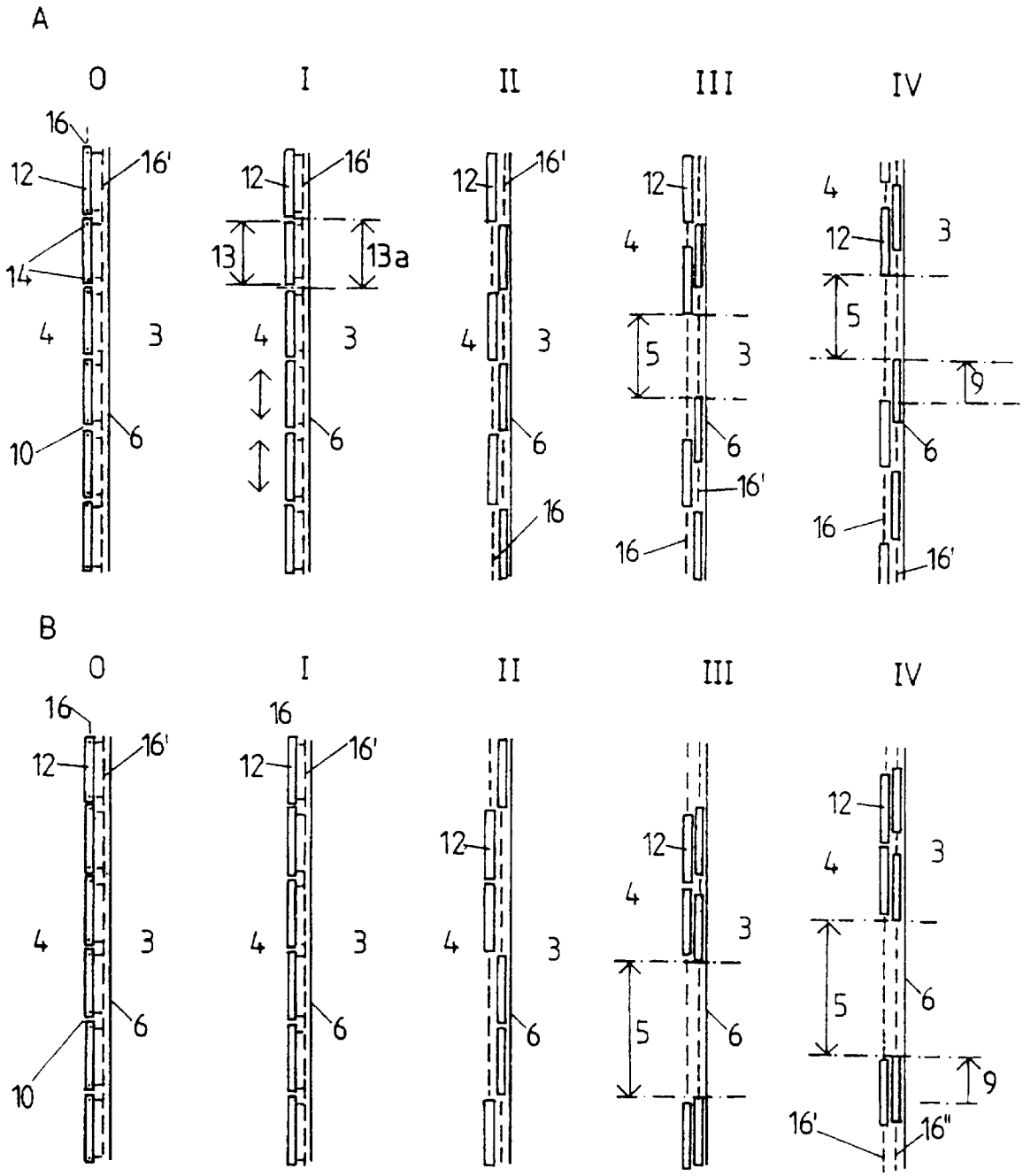
FIG. 1 is diagrammatic representation of the different opening phases of two working embodiment of the platform door system of the invention.

FIG. 1 is a diagrammatic representation of the different opening phases (0, I, II, III and IV) of two working embodiments A and B of the platform door system 1 in accordance with the invention. In the first working embodiment A a platform door system 1 is represented diagrammatically between the track 3 and the platform 4 in plan view. A barrier 10 comprises individual the barrier elements 12 of constant width 13, which respectively can be shifted in both directions. Reference numeral 13*a* indicates the axial distance between the barrier elements, i. e. the width 13 is plus the clearance distance between an adjacent barrier. Respectively two locking and guide bolts 14 are provided on the top side of a barrier element 12. These locking and guide bolts 14 are inserted into a fixed guide rail 16. Adjacent to it and parallel to the track a second guide rail 16 is provided, in which the barrier elements can be shifted.

In the 0 phase the barrier elements 12 are aligned along the platform edge. The barrier elements 12 are locked by locking and guide bolts 14. The barrier 10 is closed and movement from the platform area to the track is not possible even if accidental. The platform area 4 is specially protected against surges in air pressure so that trains may pass through the station trains at full speed.

In the phase 1 the barrier elements are unlocked, i. e. the locking and guide bolts 14 are drawn back out of the fixed locking position. The barrier 10 is still closed but is no longer so resistant to air pressure surges as in the 0 phase.

In the II phase the pre-selected barrier elements 12 are shifted from the fixed guide rail 16 to the free guide rail 16'. This is performed preferably using short offset means which in plan view are perpendicular to (i. e. athwart) the guide rail 16', such means being more particularly short rail elements. The barrier 10 is still closed; the barrier elements are now however ready to be shifted in parallelism with a longitudinal direction for uncovering an opening.

In the III phase predetermined the door elements are shifted along the guide rail 16' in order to produce a pre-selected opening arrangement.

Now the barrier 10 has openings 5 between the platform 4 and the track area 3.

In the IV phase the entire platform door system 1 is shifted along the offset path 9. Here it is possible for the barrier 10 to be shifted along the offsetting path 9 on an underlying additional rail 16.2 (not illustrated).

The phases 0 through IV cooperate as follows during the entry of a train into the station: in the case of non-stop trains the platform door system 1 is in the 0 phase, is locked and holds pressure. During normal operation it is sufficient for the platform door system 1 to be in the unlocked state in the I phase. If a train, which has to halt, is expected, the platform door system 1 changes into the condition of the II phase. The change from the I phase to the II phase is preferably accompanied by an acoustic and/or optical signal. Thus it may be appropriate to announce the start of the II phase with acoustic warning signals such as whistle blasts and also orange light. When the incoming train has almost come to a halt, the platform door system 1 changes into the III phase, i. e. the barrier elements 12 are opened at the predetermined settings. In an ideal case with the train halted the openings 5 in the barrier 10 will be opposite to the opening doors of the train. If the train misses its ideal halting point, in the optional IV phase the barrier 10 will be corrected in position by the size of error in the train's position, i. e. by the offsetting path 9. This is preferably done slowly and in the time in which the train is halting, i. e. while the train is moving along the barrier and into the station.

As soon as passengers have finished leaving and getting on the train, the individual phases may be performed in the reverse order in order to shift the platform door system 1 back into the closed form as in the I phase or the 0 phase.

In the working example B two flexible guide rails 16' and 16" are provided. The individual 0 through IV phases are generally identical to those of the working embodiment A. In the II phase the barrier elements are however shifted on both guide rails 16' and 16". This means that it is possible for each barrier element to be shifted. More particularly in the III phase this offers the advantage that it is possible to wait for the train actually to come to a halt and following this the door system is opened in accordance with the actual position of the train without follow-up motion of the entire barrier being necessary if the train should slither. However in the case of the platform door system 1 of working embodiment B as well in the IV phase it is preferred for the entire barrier 10 to be entrained along the two guide rails 16' and 16" while the train is drawing to halt.

Figures 2, 2A, 2B:
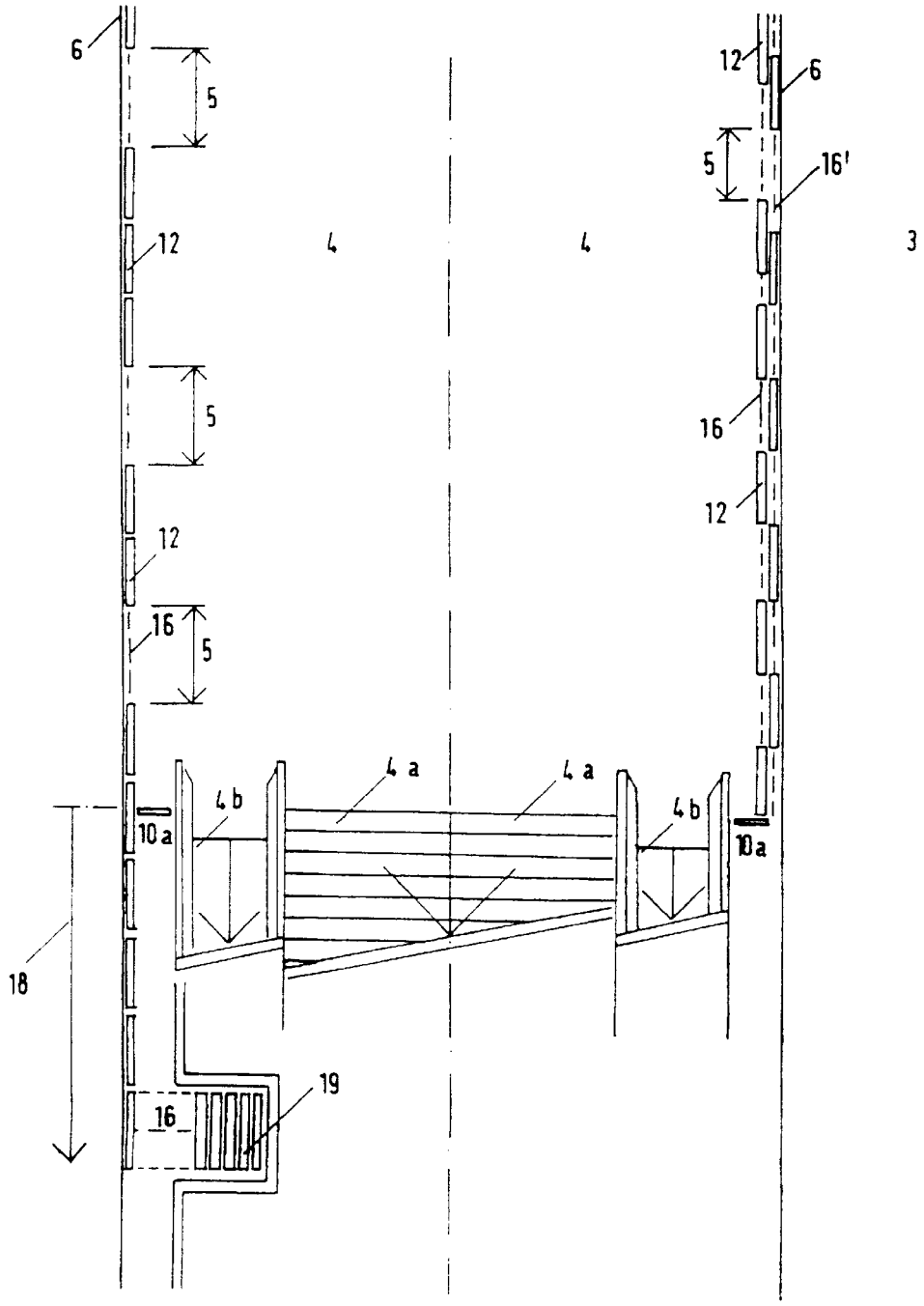
FIG. 2 shows opening arrangements of further working embodiments of the platform door system of the invention.

In FIG. 2*a* the configuration of openings of a further embodiment of the platform door system of the invention is represented. In this case it is a question of a platform door system, which makes do with a single guide rail 16. The individual barrier elements 12 are drawn to the left and to the right on opening the barrier 10 and at predetermined positions openings 5 are created. The superfluous barrier elements left on either side are either moved right along the length of the station and along the track into a holding area 18 or moved into a suitable magazine 19.

FIG. 2*b* shows a barrier 10 in accordance with the invention in the case of which the individual barrier elements 12 are shifted on a rail 16' and the configuration of openings can be produced in accordance with one of the working example of FIG. 1. In the case of this preferred working embodiment it is possible to dispense with a holding area 18 or, respectively, a magazine 19. In the working example of FIG. 2 there is the advantage of having platform barriers 10*a,* which may be opened for servicing operations for the operating personnel, whereas in operation of the system they are best kept closed.

Figure 3:
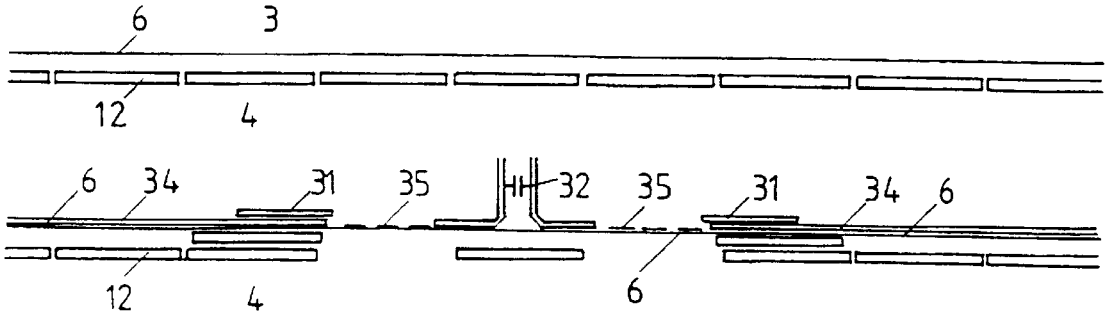
FIG. 3 is a representation of two opening phases of the working embodiments of the platform door system in accordance with the invention as in FIG. 1.

FIG. 3 is a diagrammatic representation of two opening phases of the working examples of the platform door system of the invention in accordance with FIG. 1. In this case a configuration of openings is produced, in the case of the coupling 32 of the train 30 is covered over by a barrier element 12 in order to cover over this source of danger. The remaining barrier elements 12 are adapted to the configuration of doors of the halted train.

Figure 4A:
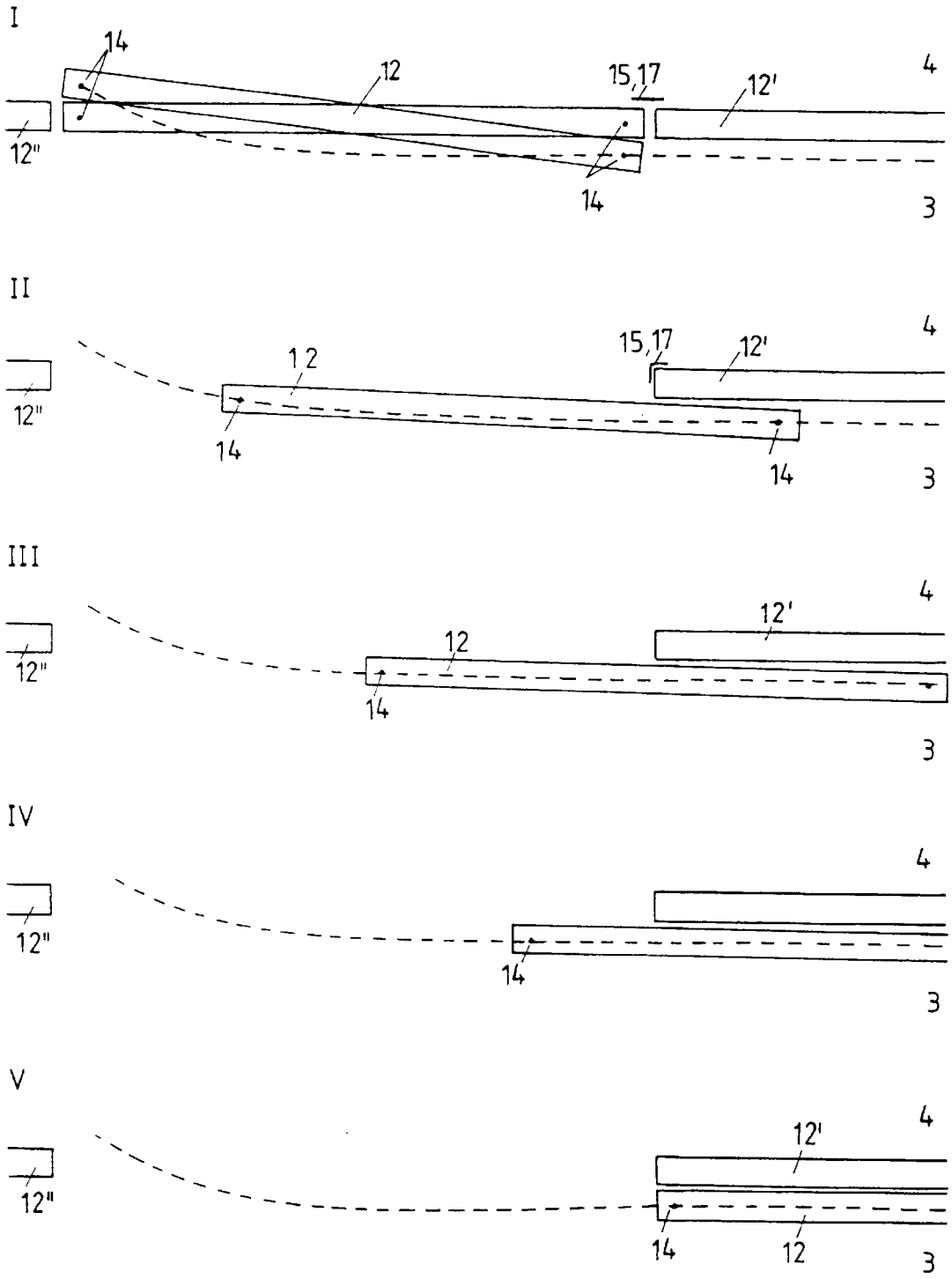
FIG. 4 is a diagrammatic representation of the different opening phases of three working embodiments of barrier elements in the platform door system of the invention.

In FIGS. 4*a,* 4*b* and 4*c* the reader will see diagrammatic representations of the different opening phases of three working examples of barrier elements 12 of the platform door system 1 of the invention.

In FIG. 4*a* pivoting of the barrier element 12 along a curve 12 as indicated in broken lines is indicated. In this case in a first I phase the barrier element 12 is slightly turned about its center axis until its front edge is located behind the rear edge of the adjacent element 12' and following this pivot in the II to V phases behind the adjacent door element 12'. This means that there is no danger of injury for the passengers. Preferably barriers 17 are additionally provided which prevent objects getting into the minimum pivot range on pivoting the barrier elements 12. It is preferred for the barriers 17 to be provided to produce a pressure sealing effect in the 0 phase.

Figure 4B:
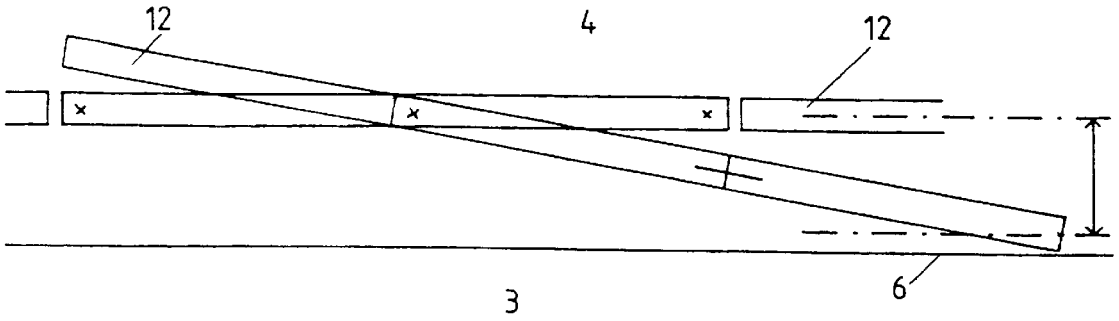

In FIG. 4*b* the barrier element 12 is pivoted about a central axis and then shifted behind the adjacent barrier element 12'. This is more especially an advantage if there is sufficient space on the platform side and in the track area.

Figure 4C:
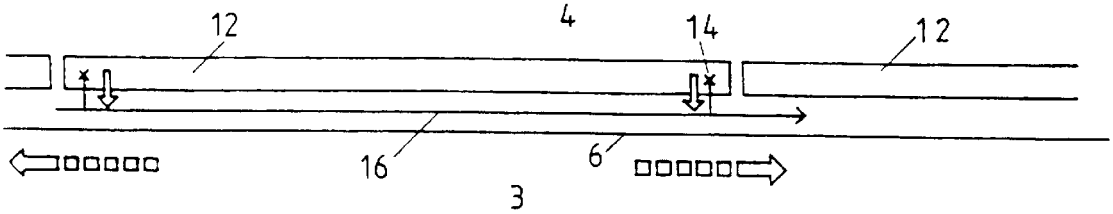

FIG. 4*c* indicates how the barrier element 12 is firstly shifted athwart the line along the barrier 10 in order to be then shifted in parallelism to the adjacent barrier element 12'.

Figure 4D:
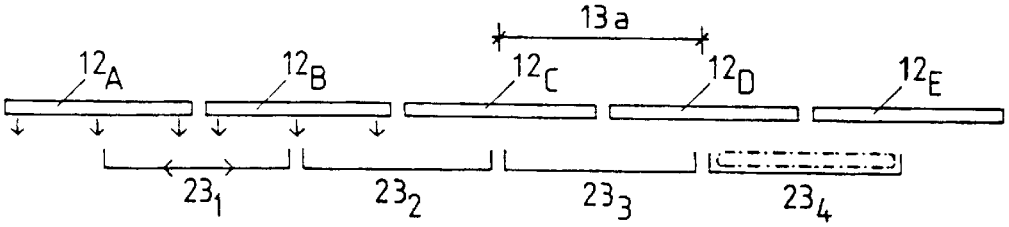

FIG. 4*d* shows a preferred combination of barrier elements 12 and drive devices or, respectively, motors 23. Each drive device with a motor 23 can selectively unlock or respectively shift two elements 12. For opening two barrier elements 12*b* and 12*c* about the width of one element the motors $\mathbf{23}_1$ and $\mathbf{23}_3$—after unlocking the locking devices 14—move the barrier elements 12 and 12*c* for the width of one barrier element width at the most to the left or, respectively, to the right. In order to move the element (12y) for instance, either the motor 23(x) of the motor 23(x+1) is operated. Using the respective motor the barrier element 12(y) can be moved either to the left or to the right. The motor therefore has a physically favorable position for moving the elements 12.

Figure 4E:
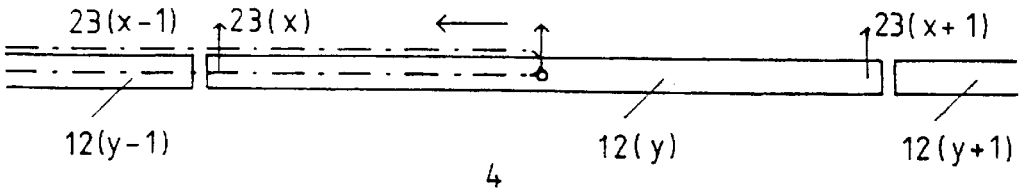

In FIG. 4*e* the working embodiment of FIG. 4*d* is illustrated in detail with reference to one barrier element 12(y) in cooperation with the barrier elements 12(y−1) and 12(y+1).

Figure 5:
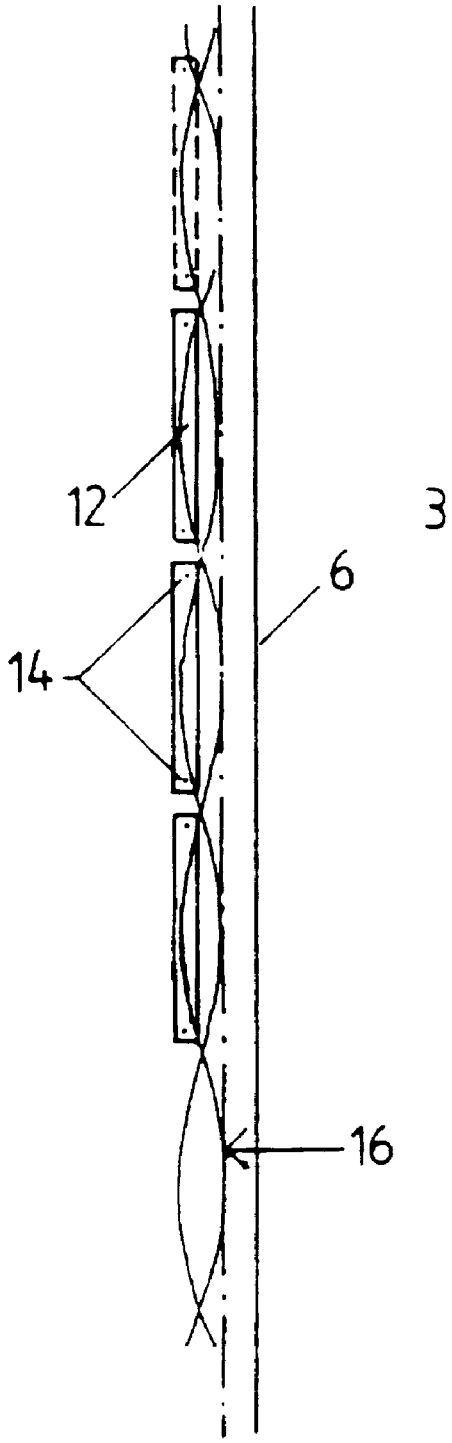
FIG. 5 is a plan view of a working embodiment of the platform door system in accordance with the invention with a groove structure as a guide.

FIG. 5 is a plan view of a working embodiment of the platform door system in accordance with the invention having a grooved structure as a guide. The barrier elements 12 here fit in sinusoidal groove structures in the guide rail 16 and can be shifted along this sinusoidal guide rail directly on after the other.

Figure 6:
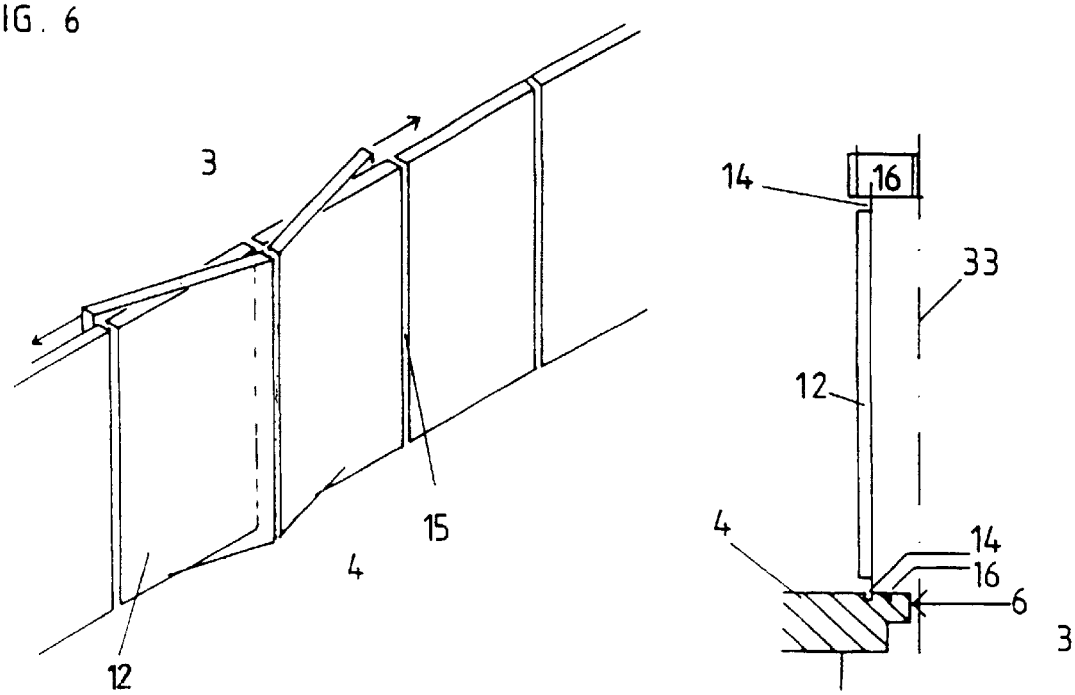
FIG. 6 is a side view of a working embodiment of barrier elements of the platform door system of the invention while opening.

FIG. 6*a* is a side view of a working example of barrier elements 12 of the platform door system 1 of the invention in the open state. This working example is similar to that of FIG. 4*b*. The barrier elements 12 are firstly pivoted by a turning movement about their center axis and then shifted into a position behind the adjacent barrier elements 12'. FIG. 6*b* shows the platform door system 1 of FIG. 6*a* in a cross section athwart the track and the platform. The barrier element 12 is suspended in a guide device 16. Locking bolts 14 are provided on the barrier element 12 in order to anchor the barrier element 12 in the guide device 16. The guide device 16 extends along as far as the clearance cross section of the train 33, which represents the limit line of the clearance cross section in the drawing as a broken line. On pivoting the barrier elements in accordance with FIG. 6*a* there is therefore sufficient space for the individual barrier elements 12 to be shifted along the guide device and behind the adjacent barrier elements into the space between the clearance cross section of the train 33 and the barrier elements 12, which have not been displaced.

Figures 7, 7A, 7B, 7C, 7D:
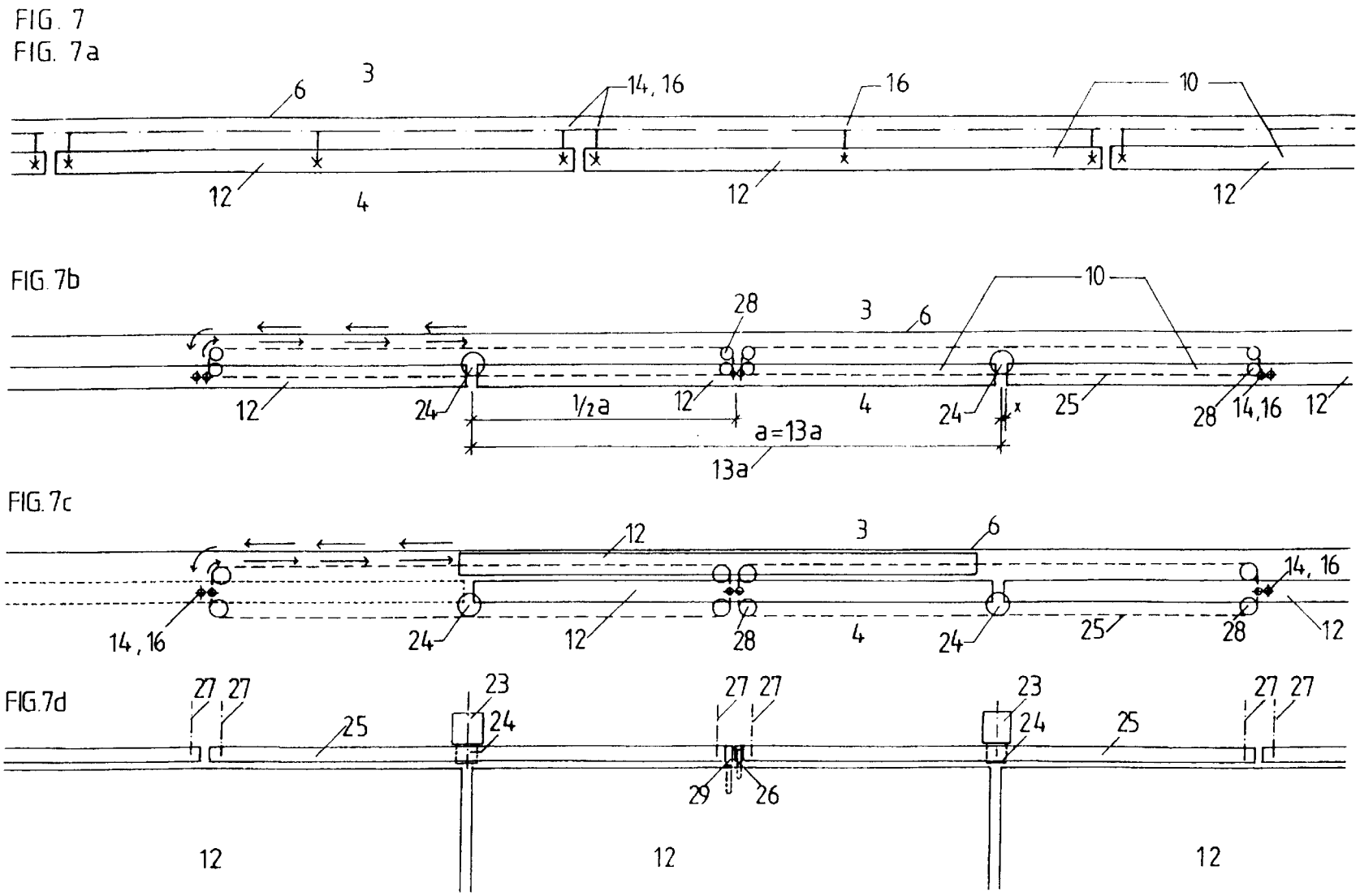
FIG. 7 is a plan view of the drive device for demonstrating the possible drive phases for opening a door leaf and shifting of a barrier element.

FIG. 7 shows a plan view of drive device for demonstration of the possible types of drive for opening a door leaf or, respectively, for displacement of a barrier element. FIG. 7 is divided up into FIGS. 7*a* through 7*d*. In FIG. 7*a* a barrier 10 is illustrated comprising individual barrier elements 12 of the present invention. The individual barrier elements 12 each have two locking devices 14.

In FIG. 7*b* the barrier elements 12 are represented with a drive mimicking means. Drive wheels 24 are driven by a motor 23 via drive transmission means 25, for example in the form of a toothed belt. Bend pulleys 28 serve to increase the radius of the individual drive element to draw it taut. Pins 26 are inserted into a catch device 29. Via a toothed belt 25 the motor 23 can actuate the respective barrier element 12 provided for opening and move it so far that the necessary width of opening is reached.

FIG. 7*c* indicates how a barrier element 12 has been shifted behind an adjacent barrier element by means of the drive wheel 24 and the toothed belt 25. It is preferred for the maximum width of opening occurring to be set by two barrier elements 12.

It is more particularly preferred for these two barrier element together to be at the most 50% wider than the maximum door width, i. e. 150% of the door width, of arriving trains. In the case of barriers 10 which can be bodily entrained to compensate for train slither (IV phase in FIG. 1) use is preferably made of barrier elements such that two thereof may cover 100% of the maximum door width.

FIG. 7*d* shows the drive device of FIGS. 7*a* through 7*c* in a lateral elevation. Here the motors 23 are represented, which are arranged over the drive wheels to drive the toothed belts 25 via the bend pulleys 28 and accordingly to provide the means able to shift the barrier elements 12. The axis or shaft of the bend pulleys 28 is indicated by reference numeral 27 in the drawing.

Accordingly a platform door system is provided which can produce adaptable or flexible configurations of openings for different configurations of doors and trains and which compensates for slither of the train.

What is claimed is:

1. A platform door system (1) comprising a barrier (10), which includes screen or barrier elements (12) able to be aligned along a track (3) and/or a platform (4), the barrier elements (12) being able to be shifted on two mutually spaced rails (16 and 16') in relation to one another in such a manner that they can at least partially overlap with each other so that freely definable, predetermined openings (5) may be created along the track (3) and/or platform (4), the barrier elements (12) being able to be shifted along the rails (16 and 16') in both directions such that should the train fail to stop in the intended position, the barrier can be shifted a distance equal to the amount by which the train has missed its intended position, characterized in that the barrier elements (12) each have locking devices (14) and sealing devices (15), the locking devices (14) serving to releasably lock the barrier elements (12) in the rails (16 and 16') and the sealing devices (15) serving to produce a seal between adjacent barrier elements (12).

2. The platform door system (1) as claimed in claim 1, characterized in that the barrier elements (12) are panel-like; and in particular that the barrier elements (12) are rectangular.

3. The platform door system (1) as claimed in either of the preceding claims, characterized in that the barrier elements (12) comprise transparent materials; in particular that the barrier elements (12) to a prevailing extent comprise glass and/or acrylics; in particular completely consist of transparent material.

4. The platform door system (1) as claimed in claim 1, characterized in that the barrier elements (12) can be shifted in relation to one another; more particularly athwart a line along a track (3) and/or along the platform (4).

5. The platform door system (1) as claimed in claim 1, characterized in that at least one barrier element can be pivoted and/or lowered and/or drawn upward.

6. The platform door system (1) as claimed in claim 1, characterized in that the barrier (10) comprises barrier elements (12) of different width.

7. The platform door system (1) as claimed in claim 1, characterized in that the locking device (14) is a bolt and the sealing device (15) is an expandable plastic bead.

8. The platform door system (1) as claimed in claim 1, characterized in that a control device (20) is provided, which controls drive devices (21), which can displace and/or shift the barrier elements (12) into a predetermined position.

9. The platform door system (1) as claimed in claim 1, characterized in that the barrier elements (12) may be provided with a functional marking, more particularly that same may assume a predetermined color in a predetermined range.

10. The platform door system (1) as claimed in claim 1, characterized in that an input unit (22) is provided by means of which a predetermined pattern may be preselected.

11. The platform door system (1) as claimed in claim 10, characterized in that the input unit (22) holds information signal, which correspond to characteristics and/or the distribution of passengers of a train and/or the distribution of passengers on a platform (4).

12. The platform door system (1) as claimed in claim 11, characterized in that the information signals are produced by a bar code reading device in front of the platform (4) and/or that the information signals are produced via a monitor system in the train and/or that the information signals are entered using an entering device, more particularly a keyboard or a graphics console.

13. The platform door system (1) as claimed in claim 1, characterized in that structural devices (7 and 8) are provided in front of and/or behind the platform, with which the track area may be shut off and more particularly hermetically sealed off.

14. A method for the operation of a plurality of barrier elements (12) of a barrier (10) of a platform door system (1) in that the barrier elements are operable to move on at least one rail, the method comprising the following steps:

displacement of barrier elements (12) so that same at least partially overlap with each other, wherein a predetermined configuration of openings is produced, which matches the opening doors of an arriving train;

resetting to correct all barrier elements by an amount equal to the amount by which the train has missed the intended position;

locking the barrier elements on one of the rails to anchor the barrier; and sealing the barrier elements in relation to each other to seal a platform.

15. The method as claimed in claim 14, which includes the following preliminary step:

offsetting the individual barrier elements (12) in relation to one another.

16. A platform door system comprising:

a barrier having multiple barrier elements operable to be linearly aligned on at least one rail;

a control device operable to shift the barrier elements along the at least one rail to move the position of the barrier elements in relation to a plurality of doors of a train;

a locking device operable to anchor the barrier elements onto the at least one rail; and a sealing device operable to provide a seal between barrier elements, where the barrier shields persons on a platform from pressure waves caused by movement of the train.

17. The platform door system of claim 16, wherein the barrier elements comprise a first barrier element and a second barrier element, where the first barrier element is operable to pivot about a central axis and to move behind the second barrier element and where the second barrier element is adjacent to the first barrier element.

18. The platform door system of claim 16, wherein the control device further comprises drive devices operable to move the barrier elements into a predetermined position.

19. The platform door system of claim 16 further comprising a guide operable to receive the locking device to attach the barrier elements to the guide.

20. The platform door system of claim 19, wherein the locking device further comprises at least one bolt.

21. The platform door system of claim 16 further comprising an input unit to transfer an input data to the platform door system.

22. The platform door system of claim 21 wherein the input data includes information signals relating to the characteristics, distribution of passengers in the train, and distribution of passengers on a platform.

23. The platform door system of claim 22 wherein the input data further includes configuration of the doors of an arriving train to determine control parameters for the system.

24. The platform door system of claim 16, wherein the control device further comprises:

a motor;

a drive wheel driven by the motor;

a drive transmission means coupled with the drive wheel;

a catch device located on the barrier elements; and pins coupled with the catch device, where the catch device is coupled with the drive transmission means, and where the motor moves the barrier elements the necessary width for an opening on the barrier.

25. A method of controlling movable barrier elements for providing or limiting access to a first opening, the method comprising:

unlocking a barrier comprising a first barrier element and a second barrier element, where the first barrier element is adjacent to the second barrier element;

pivoting the first barrier element about a center axis;

moving the first barrier element behind the second barrier element to create a second opening of predetermined width; and shifting the first barrier element and the second barrier element along an offsetting path to substantially align the second opening with the first opening.

26. The method of controlling barrier elements of claim 25 further comprising locking the first barrier element and the second barrier elements to a guide rail.

27. The method of controlling barrier elements of claim 25 further comprising sealing the first barrier element and the second barrier elements to produce a seal.

* * * * *